US005598597A

United States Patent [19]

Templeton

[11] Patent Number: 5,598,597

[45] Date of Patent: Feb. 4, 1997

[54] ELECTRIC ROLLER BALL CLEANING DEVICE

[75] Inventor: Brian C. Templeton, Calgary, Canada

[73] Assignee: Valton Enterprises, Inc., Calgary, Canada

[21] Appl. No.: 509,316

[22] Filed: Jul. 26, 1995

[51] Int. Cl.[6] ..... A63B 47/04

[52] U.S. Cl. ..... 15/21.2; 15/21.1

[58] Field of Search ..... 15/21.2, 97.2, 15/103.5, 21.1, 38, 39, 23, 97.1, 88.1, 88.2, 88.3; 134/6; 273/32 B, 32 R

[56] References Cited

U.S. PATENT DOCUMENTS

| | | | |
|---|---|---|---|
| 2,195,303 | 3/1940 | Haskins | 15/21.2 |
| 2,469,948 | 5/1949 | Bune | 15/21.2 |
| 3,103,677 | 9/1963 | Gallant . | |
| 3,150,392 | 9/1964 | Molander | 15/21.2 |
| 3,365,739 | 1/1968 | Olinghouse . | |
| 3,740,784 | 6/1973 | Morrissey | 15/21.2 |
| 4,350,457 | 9/1982 | Carnahan | 273/32 B |
| 4,381,574 | 5/1983 | Benkovsky . | |
| 5,400,455 | 3/1995 | Crossley | 15/21.2 |

*Primary Examiner*—David Scherbel
*Assistant Examiner*—James F. Hook
*Attorney, Agent, or Firm*—Donald C. Casey, Esq.

[57] ABSTRACT

A portable motor-driven device is described for cleaning balls. The device includes a cup having a cleaning medium mounted therein which forms all or a portion of a ball receiving recess and a spindle disposed thereover. The spindle engages a ball retained within the recess, and a motor provided rotates the spindle thereby rotating the ball against the cleaning medium. A solvent may be used if desired.

10 Claims, 1 Drawing Sheet

ELECTRIC ROLLER BALL CLEANING DEVICE

BACKGROUND OF THE INVENTION

This invention relates to portable ball cleaners for use principally in cleaning golf balls. In particular, this invention relates to cleaning objects by using a motor driven roller which rotates the object against a cleaning medium in a cleaning solution.

DESCRIPTION OF THE PRIOR ART

A well known problem associated with outdoor sports is the need to maintain the sporting equipment during play. While in the case of certain outdoor sports the ball played with cannot be washed, in the case of golf, it is desirable to periodically wash the ball to maintain it free of mud and other debris.

Typically, manual ball washing fixtures are provided at various locations on a golf course. These prior art devices require that the ball be manually reciprocated through a wash solution with a plunger-type device.

In addition, light weight, portable ball washers for golf balls are known in the prior art. Many of these types of devices however, are manually operable and are not sufficiently sturdy to be used on a prolonged basis.

In U.S. Pat. No. 3,365,739, there is described a motor operated ball washer wherein the ball is received in circumferential brushes and a deformed wheel is rotated by the motor. The wheel engages the ball at an edge and causes the same to rotate against the brushes. The device is intended to be attached to a golf cart and powered by a self-contained battery. The ball is received in a rounded cap for a liquid container which also contains the deformed wheel driver so that the ball is in a liquid as it rotates. Typically, the deformed wheel then engages the ball only at an edge which makes it difficult to develop sufficient friction to rotate a wet golf ball against the brushes.

In U.S. Pat. No. 4,381,574, sponges are substituted for the brushes and the container itself is caused to rotate around the ball, which remains still. Motion by the ball is arrested by a rubber member in the lid which engages the upper surface of the ball. There is not a provision described for moving the ball so that all portions of the surface are automatically washed.

The prior art further contains other types of ball washing apparatus such as U.S. Pat. No. 3,103,677 in which a machine is provided for washing bowling balls. In that device, the ball is deposited in a receptacle which has brushes mounted on the inner surface. A roller member is provided in the lower portion of the container which engages the ball and causes the ball to rotate so that a scrubbing action results from contact between the outer surface of the ball and the brushes. This patent does not describe a lid for the receptacle which would engage the upper surface of the ball.

SUMMARY OF THE INVENTION

It has been discovered however, that a device according to this invention can be provided which will automatically and efficiently scrub a golf ball or similar object and which may be mounted on a golf cart/car so that it is portable and convenient. The device of this invention utilizes a cup portion having a cleaning medium mounted on the inner surface or a portion thereof which engage the outer surface of a ball resting therein and an upper spindle member which may or may not be symmetrical so that as the motor drives the spindle, causing the same to rotate, the spindle will engage the ball and rotate it against the cleaning medium. The constitution of the cleaning medium may be a wide variety of different materials, e.g., bristles, sponge, sandpaper.

The spindle being non-symmetrical would tend to cause the ball to shift slightly on each rotation so that all surfaces are abraded and scrubbed. Typically, the motor and spindle are mounted in a lid for the device of this invention and the lower portion thereof provides the receptacle for the golf ball to be washed. The receptacle receives the golf ball in a cup portion, all or part of which is formed by the cleaning medium. When the lid is closed and the spindle engages the golf ball, it will urge the same against the cleaning medium so that as the ball is rotated by the rotating spindle, the surface will be scrubbed. In addition, if the spindle is not symmetrical as it rotates, it will shift the ball on each rotation to facilitate complete cleaning.

The spindle is intended to be motor operated and may be driven by self-contained batteries, or may be coupled to the drive system for the golf cart/car upon which it is mounted.

In addition, the housing containing the tufts and spindle may also contain a liquid cleaning solution as desired.

Accordingly, it is an object of this invention to provide a durable motor operated golf ball cleaner which is portable.

It is another object of this invention to provide a portable golf ball cleaner which may be attached to and run by the power source for a golf cart/car so that golf balls can be conveniently and efficiently cleaned.

It is still another object of this invention to provide a motor operated golf ball cleaner wherein the golf ball is driven to rotate against the cleaning medium in a cup-shaped retainer, in order to facilitate cleaning the outer surface thereof.

It is a further object of this invention to provide a motor operated golf ball cleaner wherein the ball is retained on the cleaning medium in a cup-shaped retainer and is caused to rotate relative to said cleaning medium by a motor operated spindle engaging the surface thereof wherein the spindle, if not symmetrical, will cause the golf ball to shift, facilitating complete abrasion and cleaning by the cleaning medium.

Another object of this invention is to provide the cleaner of the invention with a motor and other electrical components located above the ball so that these elements will have minimal contact with any cleaning solvent contained in the device. This reduces sealing requirements and enhances the durability and safety of the device.

These and other objects will become readily apparent with reference to the drawings and following description wherein:

DETAILED DESCRIPTION OF THE INVENTION

Figure 1:
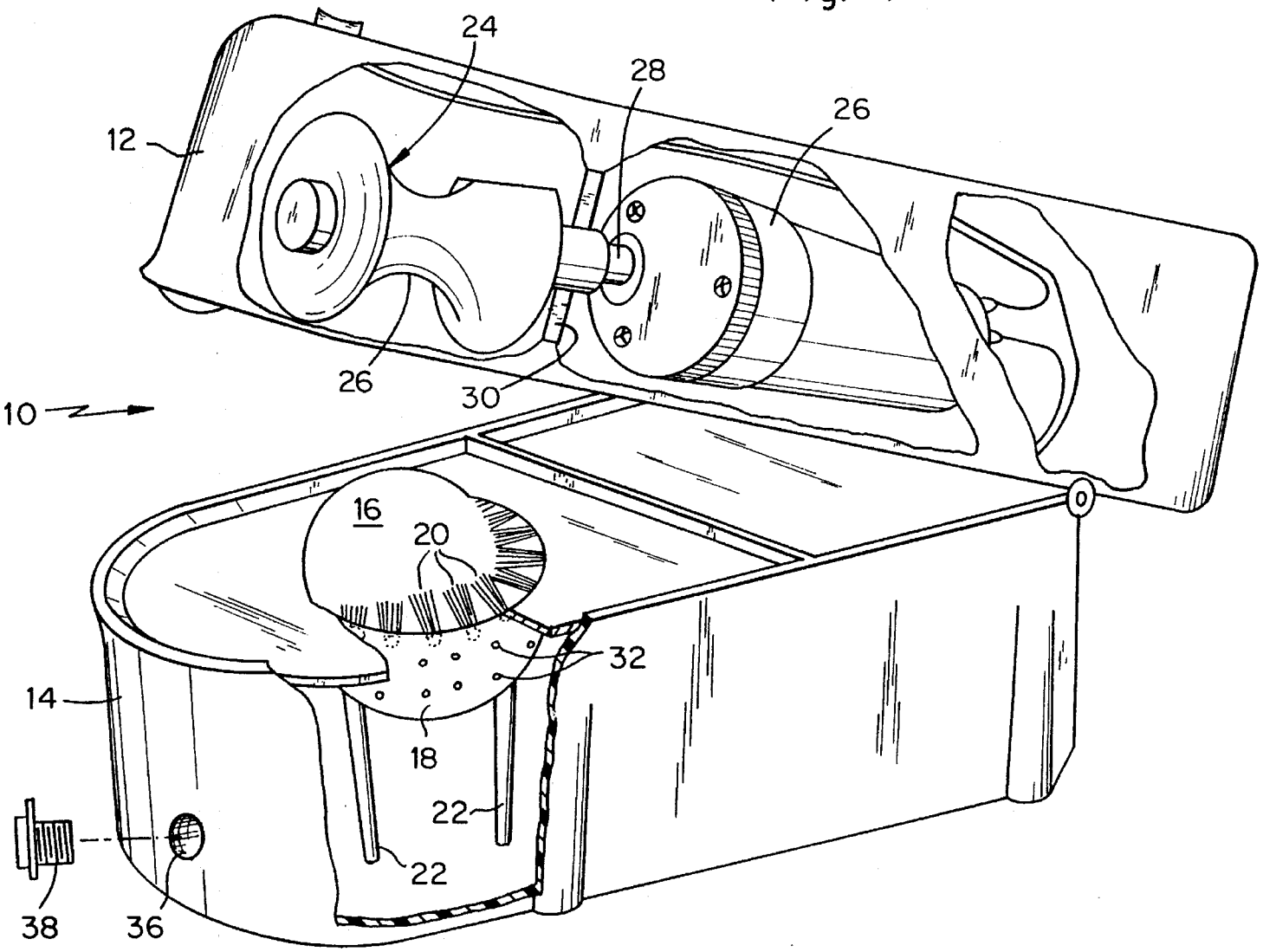
FIG. 1 is a perspective view of the device of this invention with portions of the housing removed and containing a golf ball to be cleaned.

With attention to the drawing, the device of this invention includes a housing 10 having a lid 12 and a base 14. The base 14 has a forward portion for retaining a golf ball 16 in a cup 18 having a plurality of tufts 20 (the cleaning medium)

mounted on the inner surface thereof to form a cup-shaped retention portion for receiving the golf ball 16. Typically, the cup-shaped retainer 18 has holes 32 to allow invasion into the cup of a cleaning solvent and is mounted on legs 22 within the base portion 14.

The lid 12 mounts a spindle 24 which is disposed over the golf ball 16 and is coupled to a motor 26 by a drive shaft 28. Shaft 28 extends through a water tight seal in wall 30 so that liquid cleaning compound disposed within the base portion 14 and on spindle 24 will not penetrate the motor 26. Motor 26 may be driven by a self-contained battery (not shown), or preferably is mounted on a golf cart and coupled to the power source batteries for the golf cart. Providing a source of energy for the motor 26 is not shown as it is considered to be well within the skill of an ordinary practitioner in the art.

The spindle 24 includes a cut-out portion 26 which is intended to engage the surface of the golf ball 16. The design of the spindle, in fact, is a hyperboloid of one sheet, or a cylinder having a semi-circle removed around the central portion. The spindle is designed to provide an extended surface which will frictionally engage the upper surface of the golf ball. It has been noted that when a solvent is applied to the golf ball, the surface becomes quite slick and in order to dependably and efficiently clean the surface of the ball against the cleaning medium 20, there must be surface friction between the spindle 24 and the ball 16. This is in contrast to prior art devices which engaged the ball only at a single point of tangency.

In a preferred embodiment of this invention however, the spindle 24 is asymmetrical by means of a portion of one side of the spindle being cut away 34. In this way, as the spindle rotates and drives the golf ball, the golf ball will tend to shift slightly every time the asymmetrical portion of the spindle 34 is in contact with it. It has been discovered that this extra element of agitation improves the efficiency of cleaning of the surface of the golf ball. It improves the chances of entire ball surface contacting the cleaning medium.

When in use, a golf ball is placed within the cup 18 and, if desired, a solvent also may be present in the base 14 and thus the cup by way of the holes 32. The lid 12 is then shut engaging the base 14 of housing 10 and the motor actuated by a switch (not shown).

As the drive shaft 28 rotates, the spindle 24 rotates and the cut-out portion 26 then engages the upper surface of the golf ball 16 causing the same to roll within the retainer cup 18. As the golf ball spins within the retainer cup 18, the cleaning medium 20 abrades the surface thereof. When the ball has been cleaned, the lid 12 is opened and the ball removed. After many uses the dirt, solvent or the like can be poured from the device by inverting the base 14 or by means of removing the drain plug 38, thus opening the drain hole 36. The plug is then replaced, clean solvent may then be added and the device is ready for use.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. A device for cleaning balls and the like comprising:

a water tight housing having a base and a lid adapted to close against said base;

an upwardly opening cup mounted within said base and a cleaning medium mounted within said cup and defining at least a portion of a ball-receiving recess;

a motor having an output shaft mounted within said housing lid; and means coupled to said output shaft for receiving a portion of a ball therein and for engaging a strip along the upper surface of the ball when the same is disposed in said recess and the lid is closed against the base, and for rotating said ball within the recess against the cleaning medium responsive to rotation of the shaft by said motor.

2. The device of claim 1, wherein said means for engaging is substantially cylindrical with a circumferential portion removed to receive a portion of a ball therein.

3. The device of claim 1, wherein said means for engaging is in the shape of a hyperboloid of one sheet.

4. The device of claim 2, wherein the circumferential portion removed from said means is not symmetrical.

5. The device of claim 1, wherein said motor and means for engaging are both mounted in the housing lid.

6. The device of claim 5, wherein said motor is contained within a water-tight portion of said lid.

7. Method for cleaning balls and the like comprising:

providing a water tight housing containing an upwardly opening cup lined with a cleaning medium forming at least a portion of a ball receiving recess and a lid;

placing the ball to be cleaned in said recess;

providing a motor driven elongated cylinder having a circumferential portion removed disposed in the lid;

closing the lid over the ball and thereby engaging a strip of the upper surface thereof with said circumferentially removed portion of said cylinder; and rotating the cylinder and thereby the ball against said cleaning medium.

8. The method of claim 7, wherein a solvent is provided in the base.

9. The method of claim 7, wherein the circumferentially removed portion of said cylinder is not symmetrical.

10. The method of claim 7, wherein said cylinder a hyperboloid of one sheet.

* * * * *